US008135322B2

(12) United States Patent
Kobayashi

(10) Patent No.: US 8,135,322 B2
(45) Date of Patent: Mar. 13, 2012

(54) FIXING DEVICE AND IMAGE FORMING APPARATUS

(75) Inventor: Kei Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 741 days.

(21) Appl. No.: 12/241,318

(22) Filed: Sep. 30, 2008

(65) Prior Publication Data

US 2009/0162115 A1 Jun. 25, 2009

(30) Foreign Application Priority Data

Dec. 20, 2007 (JP) ..... 2007-329121

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 4,954,845 | A * | 9/1990 | Yano et al. | 399/329 |
| 2009/0324266 | A1* | 12/2009 | Kobayashi | 399/45 |
| 2011/0200372 | A1* | 8/2011 | Arakawa | 399/333 |

FOREIGN PATENT DOCUMENTS

| | | |
|---|---|---|
| JP | 2002-270345 A | 9/2002 |
| JP | 2004-061742 A | 2/2004 |
| JP | 2005-070376 A | 3/2005 |

OTHER PUBLICATIONS

English machine translation of Japanese reference Kidokoro (JP 2004-061742 A).*

English machine translation of Japanese document, Ishii, et al. (JP 2005-070376); published Mar. 17, 2005.*

* cited by examiner

*Primary Examiner* — David Gray
*Assistant Examiner* — Geoffrey Evans
(74) *Attorney, Agent, or Firm* — Panitch Schwarze Belisario & Nadel LLP

(57) ABSTRACT

A fixing device includes a heat member, a belt member, a belt support member, a first rotation member, a second rotation member, and a separation contact mechanism. The belt member is heated by the heat member. The belt support member operably supports the belt member. The first rotation member tightly stretches the belt member with the belt support member. The second rotation member is disposed opposite to the first rotation member through the belt member. The separation contact mechanism makes the heat member to contact the belt member when the first rotation member rotates, and makes the heat member separate from the belt member when the first rotation member halts.

8 Claims, 8 Drawing Sheets

FIXING DEVICE AND IMAGE FORMING APPARATUS

BACKGROUND OF THE INVENTION

1. Field of the Invention

The present invention relates to a fixing device fixing a not yet fixed developer image by application of heat and pressure in an image forming apparatus such as a photocopier, a printer, and a facsimile machine employing an electrophotographic method and, more particularly, to a fixing device employing a belt member. In addition, the present invention relates to an image forming apparatus employing such a fixing device.

2. Description of Related Art

A related art fixing device employing a heat roller method in an electrophotographic image forming apparatus such as a photocopier, a printer, and a facsimile machine includes a heat roller for fixing a not yet fixed image by application of heat and pressure with a pressure roller. In addition to the related art fixing device employing the heat roller method, another related art fixing device employing a fixing belt such as a film or a belt member to fix a not yet fixed image by application of heat and pressure using a pressure roller and the fixing belt heated by a heat source contacting the fixing belt is known (e.g., Japanese Un-examined Patent Application Publication No. 2002-270345). Such a related art fixing device has an advantage of an energy saving or high start-up speed.

BRIEF SUMMARY OF THE INVENTION

According to one aspect of the invention, a fixing device includes: a heat member; a belt member heated by the heat member; a belt support member operably supporting the belt member; a first rotation member tightly stretching the belt member with the belt support member; a second rotation member disposed opposite to the first rotation member through the belt member; and a separation contact mechanism making the heat member contact the belt member when the first rotation member rotates and making the heat member separate from the belt member when the first rotation member halts.

According to another aspect of the present invention, an image forming apparatus includes a fixing device as described above.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
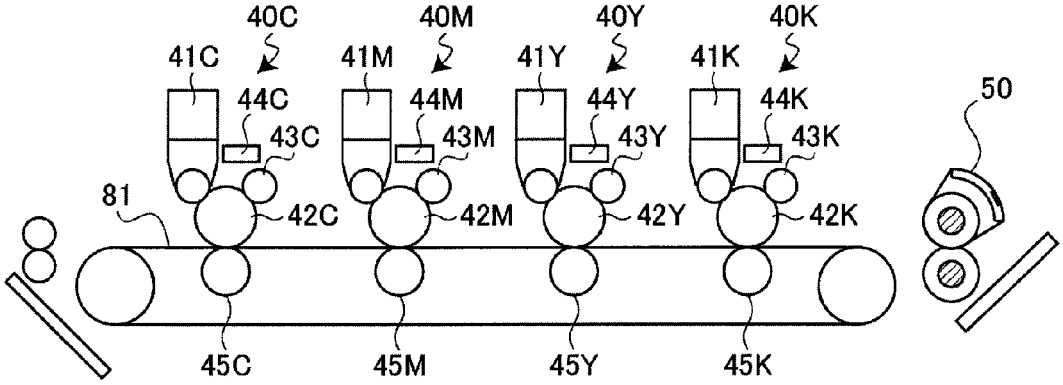
FIG. 1 is a schematic diagram illustrating an image forming apparatus of according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus and a fixing device according to first and second embodiments of the present invention are described.

First Embodiment

Referring to FIG. 1, the image forming apparatus according to the first embodiment of the present invention is illustrated. The image forming apparatus includes a fixing device 50 (described later) and forms an image on a recording medium 13 based on image data with toner made of resin including pigment as a color material. The image forming apparatus is, for example, a printer, a facsimile, a photocopier, and a multi-functional device (capable of serving at least two of the following functions, printer, facsimile machine, and photocopier) employing an electrophotographic method. The first embodiment is described with the image forming apparatus capable of providing a multi-color image. However, the first embodiment can be applied to an image forming apparatus capable of providing a monochrome image.

As illustrated in FIG. 1, the image forming apparatus according to the first embodiment includes image forming units 40C, 40M, 40Y and 40K corresponding to toner colors of cyan (C), magenta (M), yellow (Y), and black (K), respectively. The image forming units 40C, 40M, 40Y and 40K are disposed in the sequence and in parallel along a transfer belt 81 from a feeding side to an ejection side of the recording medium 13. Each of the image forming units 40C, 40M, 40Y and 40K forms a toner image of respective colors on the recording medium 13 set on the transfer belt 81 that is rotatably driven by a motor (not shown) or a gear (not shown) and the like transmitting drive force. The image forming apparatus includes the fixing device 50 disposed downstream of the image forming units 40C, 40M, 40Y and 40K. The image forming apparatus includes an external interface (not shown) that receives print data from an external device communicatably connected, and also includes a control unit (not shown)

that receives the print data from the external interface and controls the image forming apparatus as a whole.

Particularly, the image forming units 40C, 40M, 40Y and 40K respectively include: photosensitive drums 42C, 42M, 42Y, and 42K serving as electrostatic latent image carriers; charging members 43C, 43M, 43Y, and 43K charging circumference surfaces of the photosensitive drums 42C, 42M, 42Y, and 42K, respectively; latent image forming devices 44C, 44M, 44Y, and 44K serving as exposure devices such as light emitting diodes (LED) selectively irradiating the circumference surfaces of the photosensitive drums 42C, 42M, 42Y, and 42K respectively with light based on the image data received from the external device through the interface (not shown) to form the electrostatic latent images; development devices 41C, 41M, 41Y, and 41K developing the electrostatic latent images formed on the circumference surfaces of the photosensitive drums 42C, 42M, 42Y, and 42K respectively with the toner contained in a toner cartridge; and transfer members 45C, 45M, 45Y, and 45K transferring the toner images obtained by visualizing the electrostatic latent images with the toner on the recording medium 13. Each of the photosensitive drums 42C, 42M, 42Y, and 42K, charging members 43C, 43M, 43Y, and 43K, and transfer members 45C, 45M, 45Y, and 45K is rotatably driven by the motor (not shown) or the gear (not shown) and the like transmitting the drive force. Each of the latent image forming devices 44C, 44M, 44Y, and 44K, the development devices 41C, 41M, 41Y, and 41K, and the motor (not shown) is connected to a power source (not shown) and the control unit.

In the image forming units 40C, 40M, 40Y, and 40K, the charging members 43C, 43M, 43Y, and 43K applied with prescribed voltage by the power source (not shown) uniformly charge respective circumference surfaces of the photosensitive drums 42C, 42M, 42Y, and 42K under the control of the control unit (not shown). Subsequently, when the circumference surfaces of the photosensitive drums 42C, 42M, 42Y, and 42K reach respective areas in the vicinity of the latent image forming devices 44C, 44M, 44Y, and 44K with rotation of the photosensitive drums 42C, 42M, 42Y, and 42K, the latent image forming devices 44C, 44M, 44Y, and 44K irradiate respective photosensitive drums 42C, 42M, 42Y, and 42K with the light modulated thereby according to the image data so as form the electrostatic latent images. Subsequently, the image forming units 40C, 40M, 40Y, and 40K generate toner images of respective colors by attaching the toner supplied from the development devices 41C, 41M, 41Y, and 41K to respective electrostatic latent images on the photosensitive drums 42C, 42M, 42Y, and 42K.

With rotation of the photosensitive drums 42C, 42M, 42Y, and 42K under the control of the control unit (not shown), the circumference surfaces of the photosensitive drums 42C, 42M, 42Y, and 42K having the toner images developed by respective development devices 41C, 41M, 41Y, and 41K reach respective areas in the vicinity of the transfer members 45C, 45M, 45Y, and 45K that are disposed opposite to the photosensitive drums 42C, 42M, 42Y, and 42K respectively in such a manner to sandwich the transfer belt 81 therebetween. The transfer members 45C, 45M, 45Y, and 45K sequentially overlay and transfer respective toner images to the recording medium 13 in corresponding to conveyance of the recording medium 13 by the transfer belt 81. Here, each of the transfer members 45C, 45M, 45Y, and 45K is applied with prescribed voltage by the power source (not shown).

In the image forming apparatus, the image forming units 40C, 40M, 40Y, and 40K sequentially form images of respective colors on the recording medium 13, thereby forming a multi-color image. In the image forming apparatus, the recording medium 13 is conveyed to the fixing device 50 while being in a state of electrostatically absorbed to the transfer belt 81, so that the fixing device 50 fixes the multi-color image formed on the recording medium 13.

Figure 2:
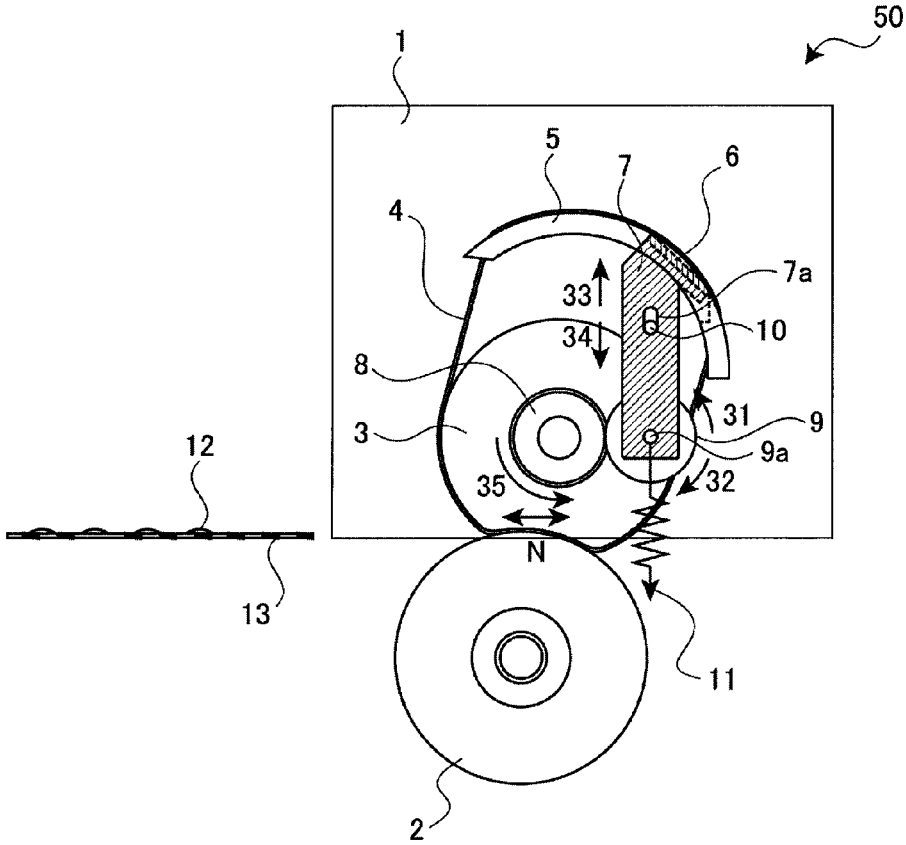
FIG. 2 is a side view illustrating a fixing device included in the image forming apparatus according to the first embodiment.
Figure 3:
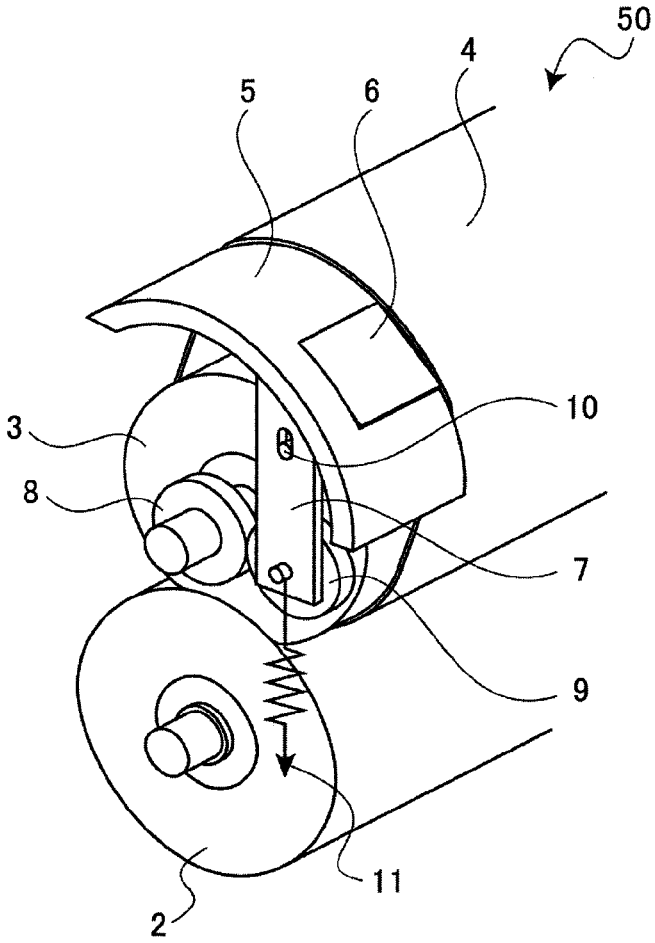
FIG. 3 is a perspective view illustrating the fixing device included in the image forming apparatus according to the first embodiment.

Now, a detailed description of the fixing device 50 included in the image forming apparatus is given with reference to FIGS. 2 and 3. The fixing device 50 is illustrated in a side view and in a perspective view in FIGS. 2 and 3, respectively. The fixing device 50 includes a fixing belt unit 1 serving as a fixing member and a pressure roller 2 that is a pressure member serving as a second rotation member. A fixing nip N is formed by pressing the fixing belt unit 1 against the pressure roller 2, so that unfixed toner 12 is fixed on the recording medium 13 by application of heat and pressure.

The fixing belt unit 1 includes a fixing belt 4 serving as a belt member, a fixing roller serving as a first rotation member, a belt support member 5, a heat source 6 serving as a heat member, a heat source support member 7, and a separation contact mechanism. The pressure roller 2 is rotatably held in a bearing, is disposed in such a manner to sandwich the fixing belt 4 with respect to the fixing roller 3, and is pressed with a prescribed pressure force in a direction of the fixing belt unit 1.

Each of the pressure roller 2 and the fixing roller 3 has an outside diameter of approximately 20 to 40 mm and includes a heat-resistance elastic layer having a thickness of 1 to 10 mm at an outer circumference surface of a metal core. A release layer made of a florin resin such as perfluoroalkoxy alkan (PFA), polytetrafluoroethylene (PTFE), and poly(tetrafluoroethylene-co-hexafluoropropylene)(FEP) having a thickness of 10 to 50 μm is formed on the outer circumference surface. The metal core can be made of metal such as iron and aluminum, and the heat-resistance elastic layer can be employed with an elastic member made of silicone rubber, silicone sponge, fluorine rubber, and the like.

Figure 4:
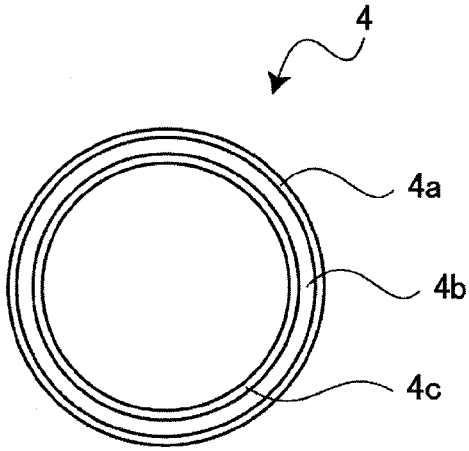
FIG. 4 is a schematic diagram illustrating a fixing belt of the fixing device according to the first embodiment.

The fixing belt 4 is an endless belt having a prescribed width, and is tightly stretched by the fixing roller 3 and the belt support member 5. The fixing belt 4 is heated by the heat source 6. The fixing belt 4 is rotatably driven by frictional force generated in the nip N with the rotation of the pressure roller 2. Here, the fixing roller 3 is rotated with the rotation of the fixing belt 4. As illustrated in FIG. 4, the fixing belt 4 includes a release layer 4*a*, an elastic layer 4*b*, and a base member 4*c*. The elastic layer 4*b* having the release layer 4*a* on a surface thereof is formed on the base member 4*c* that is in an endless shape and made of a material such as nickel, polyimide, and stainless. The elastic layer 4*b* is a thin layer made of silicone rubber or fluorine resin. The release layer 4*a* is made of a material such as PFA, PTFE, and FEP having good release property and heat resistance property. The fixing belt 4 preferably includes the base member 4*c* having a thickness of 30 to 150 μm, the elastic layer 4*b* having a thickness of 50 to 300 μm, and the release layer 4*a* having a thickness of 10 to 50 μm from a strength or heat resistance standpoint. A thermistor (not shown) serving as a temperature detection element is disposed in the vicinity of a surface of the fixing belt 4.

The belt support member 5 is disposed separated from the fixing roller 3 and opposite to the pressure roller 2 in such a manner to sandwich the fixing roller 3 therebetween, and operably supports the fixing belt 4. The belt support member 5 tightly stretches the fixing belt 4 with the fixing roller 3. The belt support member is made of resin having high heat-resistance such as polyphenylene sulfide (PPS), polyether ether ketone (PEEK), and liquid crystal polymer (LCP). Such a high heat-resistance material may be reinforced by adding glass fiber, glass beads and the like in consideration of deformations or damages caused by the heat. In an area between the belt support member 5 and the fixing belt 4, a lubricant such as fluorine grease may be applied to the belt support member 5 for friction reduction.

Figure 5:
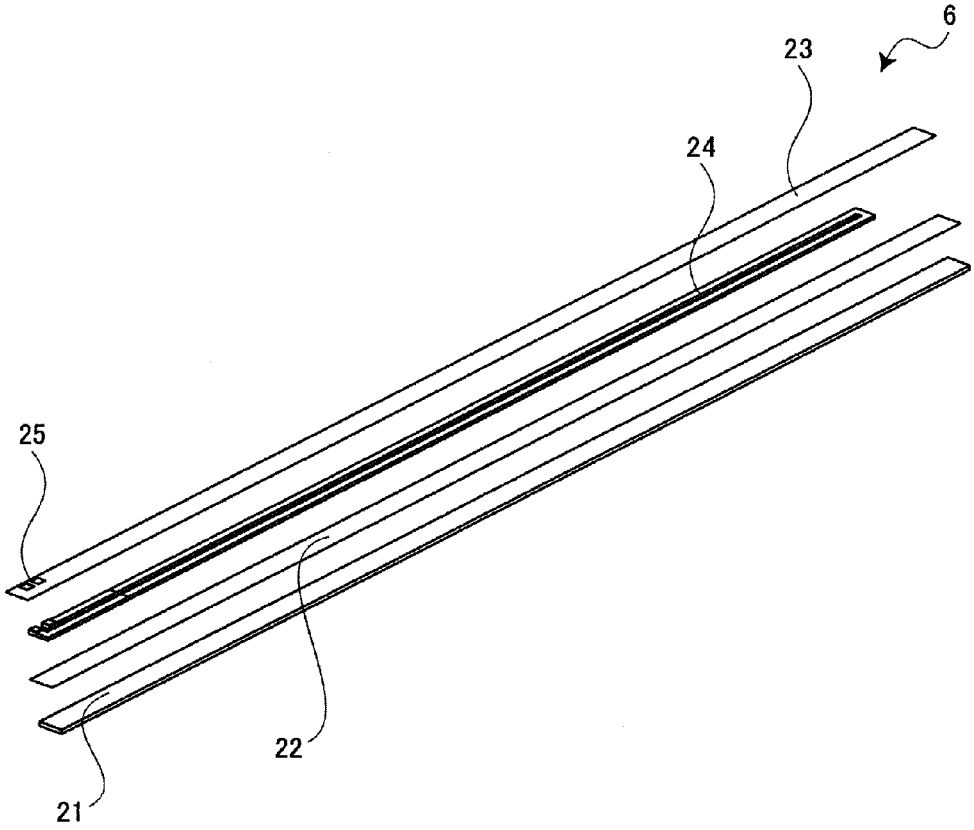
FIG. 5 is a schematic diagram illustrating a heat source of the fixing device according to the first embodiment.

Referring to FIG. 5, the heat source 6 is illustrated in a schematic diagram. The heat source 6 in a sheet shape serving as the heat member includes an electrical insulation layer 22 made of glass and the like on a substrate 21 made of stainless, ceramic and the like, a resistance heating member 24 and an electrode 25 coated on the electrical insulation layer 22, and a protection layer 23 protecting the heat source 6 as illustrated in FIG. 5. The heat source 6 is wider than the fixing belt 4 such that the electrode 25 formed at an end of the heat source 6 does not contact the fixing belt 4. The heat source 6 may include a curvature that is substantially similar to that of the fixing belt 4. The resistance heating member 24 of the heat source 6 can be made of a material, for example, nickel-chrome alloy and silver-palladium alloy and includes powders of such a material. The protection layer 23 can be made of glass or fluorine resin such as PFA, PTFE, and FEP. According to the first embodiment, the heat source 6 serving as the heat member in the sheet shape is disposed in such a manner to be separable from and contactable inner surface of the fixing belt 4. Alternatively, the heat source 6 may be disposed in such a manner to be separable from and contactable an outer surface of the fixing belt 4. According to the first embodiment, the heat source 6 is in the sheet shape. Alternatively, the heat source 6 may be in a cylindrical shape, however, the shape of the heat source 6 is not limited thereto.

The heat source 6 is supported by the heat source support member 7. The heat source support member 7 includes a long hole 7*a* extending in a longitudinal direction thereof, and a steady pin 10 inserted into the long hole 7. A movement of the heat support member 7 is limited by the steady pin 10 such that the heat support member 7 is not moved in a direction except for the longitudinal direction thereof. That is, a movement of the heat source 6 supported by the heat source support member 7 is limited such that the heat source 6 is not moved in a direction except for a direction approaching the fixing belt 4 (i.e., a direction indicated by an arrow 33 in the FIG. 2) and a direction separating from the fixing belt 4 (i.e., a direction indicated by an arrow 34 in FIG. 2). The heat source support member 7 includes a spring 11 serving as an urging member urging in a direction in which the heat source 6 is separated from the fixing belt 4. The spring 11 is disposed at an end of the heat source support member 7 with respect to an opposite end by which the heat source 6 is supported.

A one-way gear 9 serving as an element of the separation contact mechanism is attached to the heat source support member 7. The one-way gear 9 is disposed at the end of the heat source support member 7 with respect to the opposite end by which the heat source 6 is supported. The one-way gear 9 is supported by a frame member (not shown) such that a support shaft 9*a* is movable in the directions indicated by the arrows 33 and 34 with the heat source support member 7. The one-way gear 9 rotates in a direction (i.e., a direction indicated by an arrow 31 shown in FIG. 2) that is the same direction as a rotation direction of the fixing roller 3 (i.e., a direction indicated by an arrow 35 shown in FIG. 2) with respect to the support shaft 9*a*, and does not rotate in a reverse direction indicated by an arrow 32 shown in FIG. 2. The one-way gear 9 rotates in response to a gear 8 that is attached to an end of the metal core of the fixing roller 3. The gear 8 includes a torque limiter serving as an element of the separation contact mechanism, and is disposed in such that rotation thereof is halted by application of a load that is larger than a prescribed amount.

Since the heat source support member 7 includes the one-way gear 9 and the spring 11 described above, the heat source support member 7 is applied with prescribed force in the directions indicated by the arrows 33 and 34. By rotation of the gear 8, the one-way gear 9 moves in the direction (indicated by the arrow 33 shown in FIG. 2) in which the heat source 6 approaches the fixing belt 4. The force applied to the heat source support member 7 by the gear 8 is represented as Fa (described later). The heat source support member 7 is pulled by the spring 11 in the direction (indicated by the arrow 34 shown in FIG. 2) in which the heat source 6 is separated from the fixing belt 4. The force applied to the heat source support member 7 by the spring 11 is represented by Fb. The gear 8 and the spring 11 are disposed in such a manner to satisfy a relationship Fa>Fb.

Such a fixing device 50 operates as described below when the toner image is formed on the recording medium 13 by the image forming units 40 and is conveyed to the fixing device 50.

Initially, the pressure roller 2 is driven to rotate. Subsequently, the fixing belt 4 is rotatably driven with the rotation of the pressure roller 2 while sliding with respect to the belt support member 5 and the heat source 6, and the fixing roller 3 is also rotatably driven. Here, the gear 8 attached to the metal core of the fixing roller 3 rotates with rotation of the fixing roller 3. Here, the one-way gear 9 does not rotate in the direction indicated by the arrow 32 shown in FIG. 2 with respect to the support shaft 9*a*. Since the force applied to the heat source support member 7 by the gear 8 and the spring 11 satisfies the relationship Fa>Fb, the one-way gear 9 moves along a surface of the gear 8 by rotation of the gear 8. The heat source support member 7 moves in the direction indicated by the arrow 33 shown in FIG. 2 until a lower portion of the long hole 7*a* of the heat source support member 7 contacts the steady pin 10. Consequently, the heat source 6 supported by the heat source support member 7 is pressed against the inner surface of the fixing belt 4.

The rotation of the gear 8 is halted by the torque limiter when the heat source 6 is pressed against the inner surface of the fixing belt 4. In this way, the heat source support member 7 retains a position thereof, and the fixing roller 3 idles with respect to the gear 8. That is, the force applied to the heat source support member 7 by the gear 8 and the spring 11 remains in a state of Fa>Fb. The fixing roller 3 continues to be rotatably driven. When the electric power is supplied to the heat source 6, a contact portion between the heat source 6 and the fixing belt 4 is heated. Here, a temperature detection mechanism (not shown) detects surface temperature of the fixing belt 4, and a control unit (not shown) controls the electric power supplied to the heat source 6 based on the temperature detected by the temperature detection mechanism, so that the surface temperature of the fixing belt 4 remains at an appropriate level.

The pressure roller 2 is pressed against the fixing roller 3 with the fixing belt 4 therebetween, thereby forming the fixing nip N. The recording medium 13 having the unfixed toner 12 transferred thereon is conveyed to the fixing nip N between the fixing belt 4 and the pressure roller 2. The heated fixing belt 4 fixes the unfixed toner 12 transferred on the recording medium 13 being conveyed thereto with application of heat and pressure while rotating with the pressure roller 2.

Figure 6:
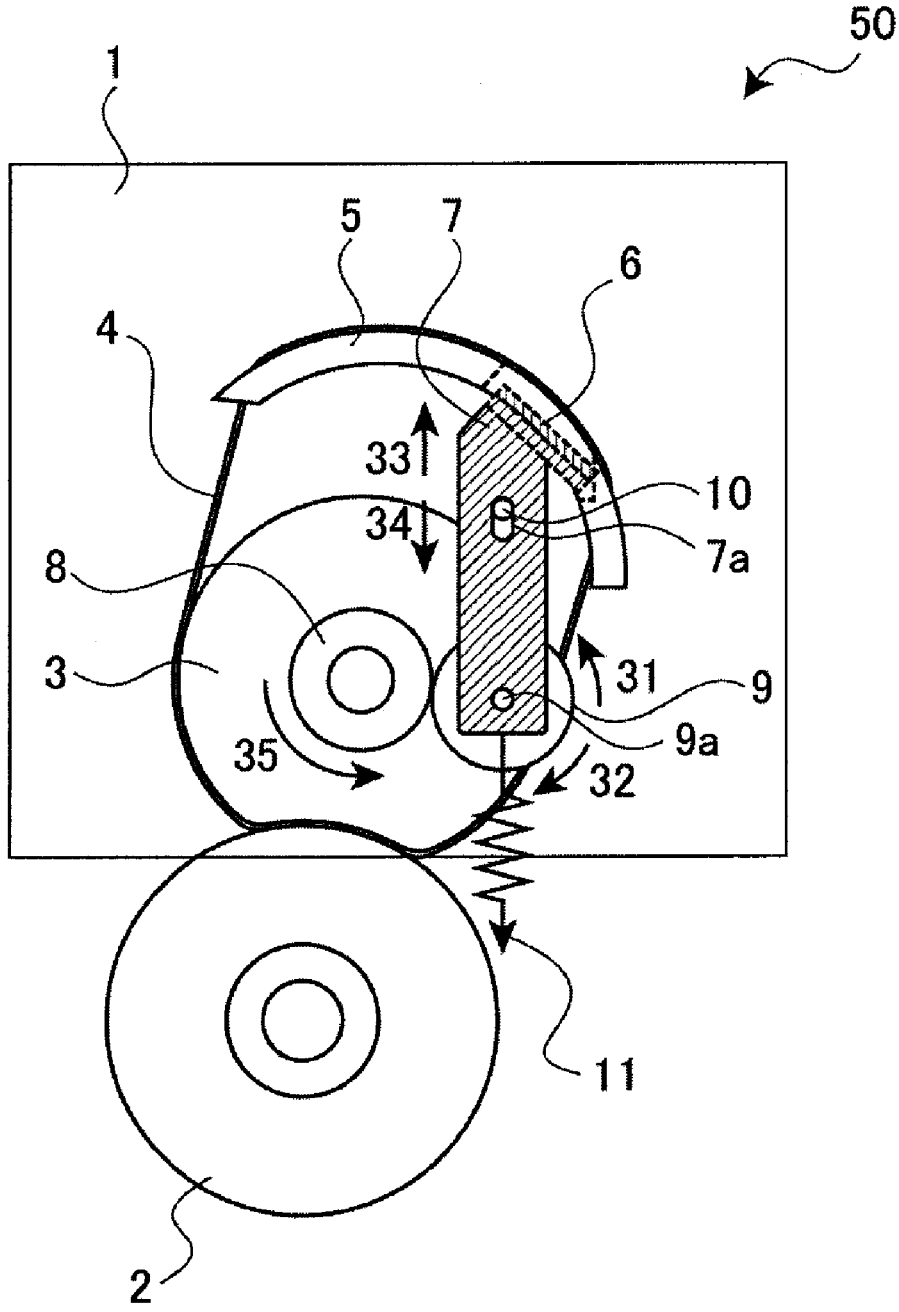
FIG. 6 is a schematic diagram illustrating a state in which the heat source and the fixing belt in the fixing device according to the first embodiment are separated.

In a case where the fixing belt 4 is halted by any reason, for example, a skid between the fixing belt 4 and the pressure roller 2, the fixing device 50 according to the first embodiment of the present invention operates as follows. When the rotation of the fixing belt 4 halts, the rotation of fixing roller 3 driven by the fixing belt 4 is halted, causing the force Fa applied to the heat source support member 7 becomes zero. Here, the one-way gear 9 is rotated in the direction indicated by the arrow 31 shown in FIG. 6 by the force Fb applied by the spring 11, and the heat source support member 7 is pulled in the direction indicated by the arrow 34 shown in FIG. 6, that is, a direction in which that the heat source 6 is separated from the fixing belt 4 as illustrated in FIG. 6. Consequently, the heat source is promptly separated from the fixing belt 4.

Figure 7:
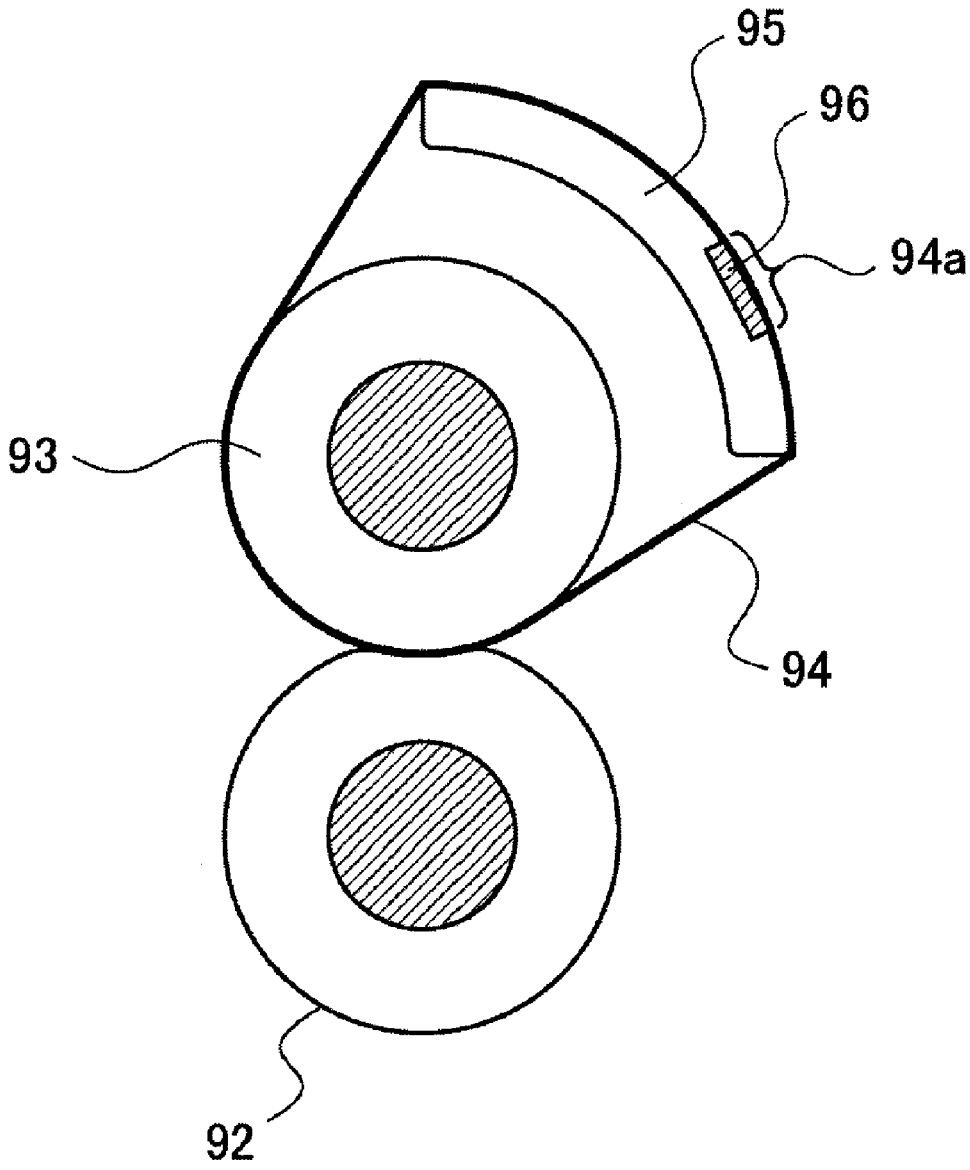
FIG. 7 PRIOR ART
FIG. 7 is a side view illustrating a conventional fixing device.

Referring to FIG. 7, a conventional fixing device employing a fixing belt is illustrated as a comparative example. The conventional fixing device includes a pressure roller 92, a fixing roller 93, a fixing belt 94, a belt support member 95, and a heat source 96. The pressure roller 92 is rotatably driven by a drive source (not shown). The fixing roller 93 is disposed inside the fixing belt 94 in a position opposite to the pressure roller 92 and is pressed against the pressure roller 92, thereby forming a fixing nip. The fixing belt 94 is tightly stretched by the fixing roller 93 and the belt support member 95, and is rotatably driven by rotation of the pressure roller 92. The heat source 96 is in a sheet shape and contacts inside the fixing belt 94.

In such a conventional fixing device of the comparative example, the pressure roller 92 is rotatably driven by the drive source, and the fixing belt 94 and the fixing roller 93 are rotatably driven by friction exerted between the pressure roller 92 and the fixing belt 94 and friction exerted between the fixing belt 94 and the fixing roller 93. A recording medium passes through the fixing nip with temperature of the fixing belt 94 controlled at a prescribed level by the heat source 96, so that unfixed toner is fixed on the recording medium by application of heat and pressure.

In a case where the movement of the fixing belt 94 in the fixing device of the comparative example halts by any reason such as the skid between the fixing belt 94 and the pressure roller 92, a contact portion 94*a*, within the fixing belt 94, contacting the heat source 96 is excessively heated. Such excess heat causes the fixing belt 94 to be damaged.

According to the fixing device 50 of the first embodiment, the rotation of the pressure roller 2 drives the fixing belt 4 and the fixing roller 3 to rotate. With rotation of the gear 8 in response to the fixing roller 3, the one-way gear 9 moves to the direction in which the heat source 6 approaches the fixing belt 4 with the heat source support member 7. The heat source 6 contacts the fixing belt 4. Here, the heat source 6 is pressed against the inner surface of the fixing belt 4, thereby halting the rotation of the gear 8, so that the heat source support member 7 retains the position thereof and the heat source 6 remains in contact with the fixing belt 4 by idling the fixing roller 3 with respect to the gear 8. On the other hand, where the movement of the fixing belt 4 halts, the heat source support member 7 moves in the direction in which the heat source 6 is separated from the fixing belt 4 by the urging of the spring 11. That is, the separation contact mechanism including the torque limiter provided to the one-way gear 9 and the gear 8 allows the heat source 6 to contact the fixing belt 4 when the fixing roller 3 rotates, and allows the heat source 6 to be separated from the fixing belt 4 when the rotation of the fixing roller 3 halts.

According to the first embodiment, where the rotation of the fixing belt 4 halts, the fixing device 50 can reduce (if not eliminate) an occurrence of contacting the fixing belt 4 by the heat source 6 and can reduce (if not prevent) excess heat applied to a portion of the fixing belt 4 without a special control mechanism. Therefore, the fixing device 50 including the fixing belt 4 with a long lifespan without being damaged and the image forming apparatus including the fixing device 50 can be provided according to the first embodiment.

Second Embodiment

In the first embodiment described above, the heat source 6 and the fixing belt 4 are separated so as to reduce (if not prevent) the damage of the fixing belt 4. However, when the heat source 6 is separated from the fixing belt 4, the heat of the heat source 6 may not be removed, and the temperature of the heat source 6 may excessively increase, causing an increase in the possibility of damaging the heat source 6. In a second embodiment of the present invention, a description is given of a fixing device capable of reducing (if not preventing) the possibility of damaging a heat source caused by separation of the heat source 6 from the fixing belt 4, and an image forming apparatus including such a fixing device. That is, the fixing device and the image forming apparatus according to the second embodiment can reduce (if not prevent) the damage of the heat source by blocking electric power supplied to the heat source by halting the rotation of a fixing roller 3.

The image forming apparatus according to the second embodiment includes a fixing device 51 (described later) that is disposed instead of the fixing device 50 of the first embodiment. In the second embodiment, elements and configurations of the image forming apparatus that differ from those of the above first embodiment will be described later, and like elements will be given the same reference numerals as above and description thereof will be omitted.

Figure 8:
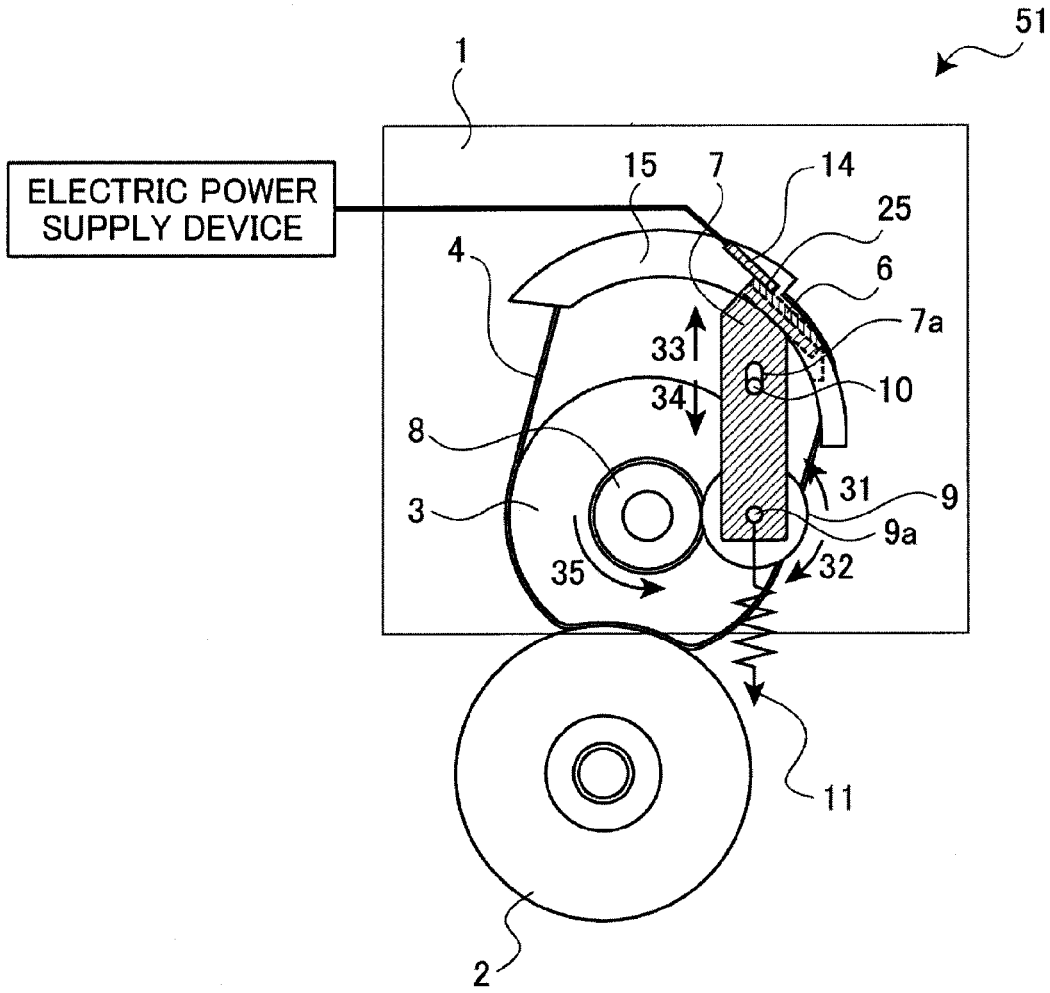
FIG. 8 is a side view illustrating a fixing device according to a second embodiment of the present invention.
Figure 9:
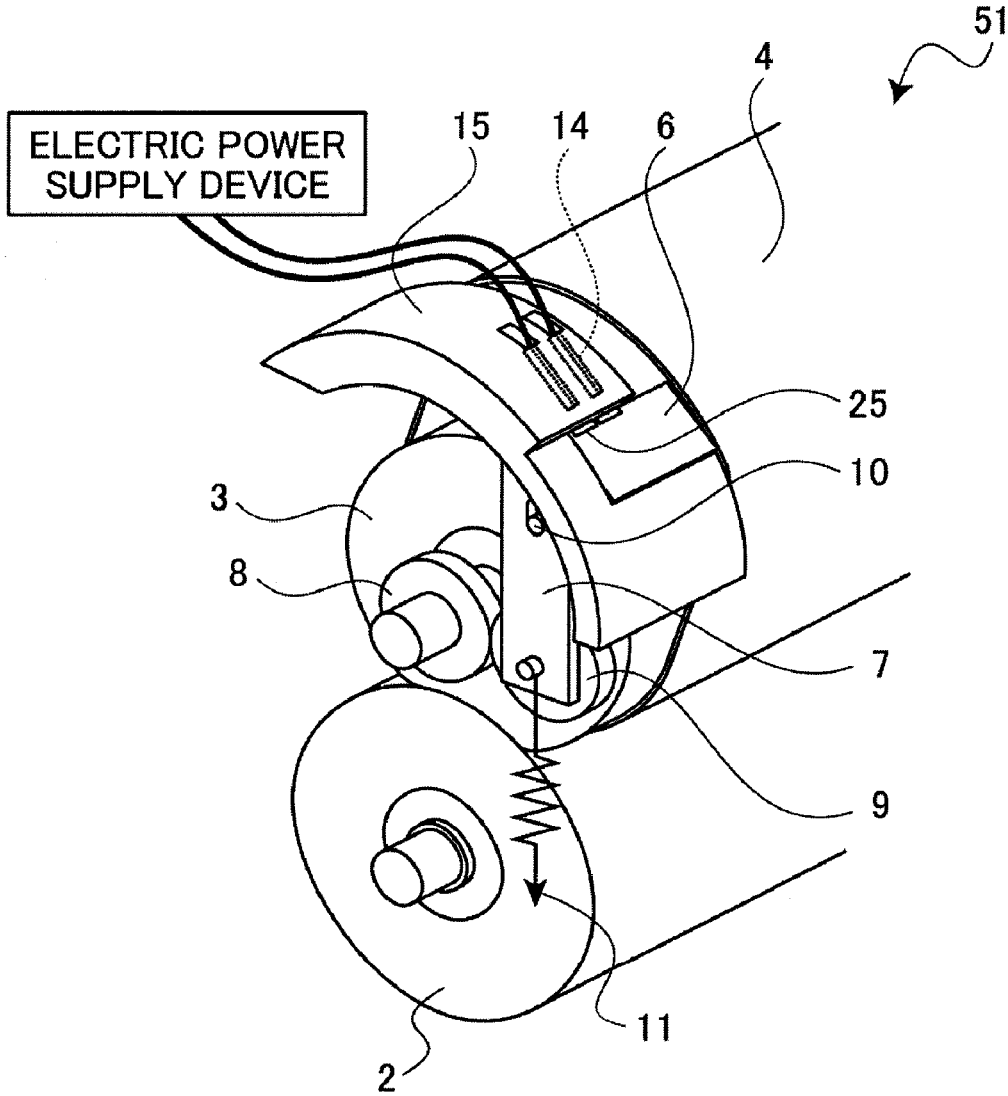
FIG. 9 is a perspective view illustrating the fixing device according to a second embodiment of the present invention.

Referring to FIGS. 8 and 9, the fixing device 51 according to the second embodiment is illustrated in a side view and a perspective view, respectively. As similar to the fixing device 50 of the first embodiment, the fixing device 51 includes a fixing belt unit 1 serving as a fixing member and a pressure roller 2 that is a pressure member serving as a second rotation member. The fixing belt unit 1 includes a fixing belt 4 serving as a belt member, a fixing roller 3 serving as a first rotation member, a belt support member 15, a heat source 6 serving as a heat member, a heat source support member 7, and a separation contact mechanism. The pressure roller 2, the fixing belt 4, the fixing roller 3, the heat source 6, the heat source support member 7 and the separation contact mechanism are substantially the same as those of the first embodiment and description thereof will be omitted.

The belt support member 15 is disposed separated from the fixing roller 3 and opposite to the pressure roller 2 in such a manner to sandwich the fixing roller 3 therebetween, and operably supports the fixing belt 4. The belt support member 15 tightly stretches the fixing belt 4 with the fixing roller 3. The heat source 6 includes an electrode 25 disposed in such a manner not to contact the fixing belt 4. The belt support member 15 includes a connector 14 disposed in such a manner to contact an electrode 25 of the heat source 6 when the heat source 6 and the fixing belt 4 contact each other. The connector 14 is connected to an electric power supply device, so that the electric power is supplied to the heat source 6 when the connector 14 and the electrode 25 contact each other.

The heat source support member 7 according to the second embodiment operates substantially similar to that of the first embodiment. In other words, the rotation of the fixing belt 4 and the fixing roller 3 allows the heat source support member 7 to move in a direction in which the heat source 6 approaches the fixing belt 4, so that the heat source 6 and the fixing belt 4 contact each other. Here, the electrode 25 of the heat source 6 and the connector 14 contact each other. Therefore, the contact of the heat source 6 and the fixing belt 4 allows the electric power to be supplied to the heat source 6 from the electric power supply device, thereby increasing the temperature of the heat source 6 and heating the fixing belt 4. The heated fixing belt 4 fixes the unfixed toner on the recording medium as similar to that of the first embodiment.

Figure 10:
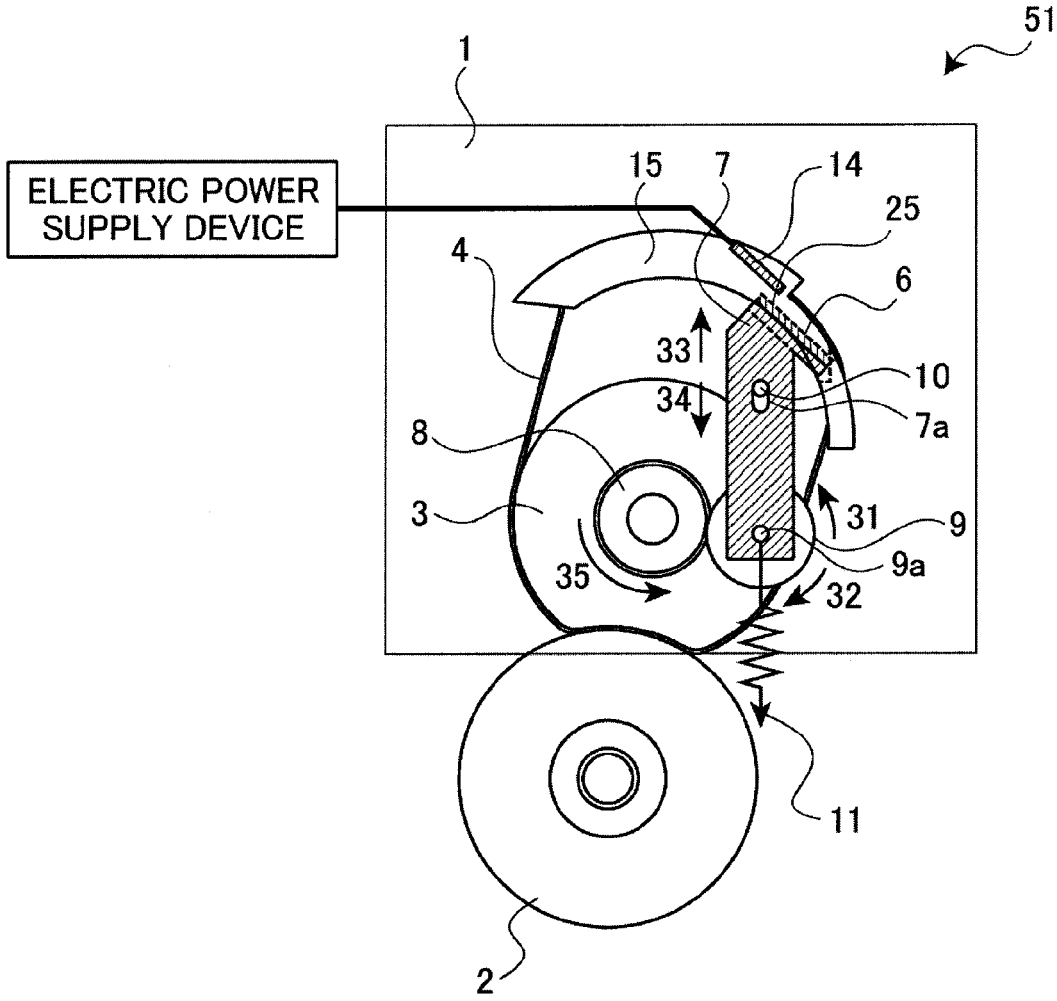
FIG. 10 is a schematic diagram illustrating a state in which the heat source and the fixing belt in the fixing device according to the second embodiment are separated.

On the other hand, in a case where the rotation of the fixing belt and the fixing roller 3 halts, the heat source support member 7 moves in a direction in which the heat source 6 is separated from the fixing belt 4, so that the heat source 6 and the fixing belt 4 are separated as illustrated in FIG. 10. Here, the electrode 25 of the heat source 6 is separated from the connector 14, so that the electric power supplied to the heat source 6 is blocked. In this regard, the temperature of the heat source 6 is not increased. That is, the heat source 6 can reduce (if not prevent) the excessive increase in the temperature thereof by separation of the fixing belt 4. Therefore, the fixing device 50 including the heat source 6 with long lifespan without being damaged and the image forming apparatus including the fixing device can be provided according to the second embodiment.

The fixing device 50 described above in the first and second embodiments can be applied as a mechanism and a device fixing the not yet fixed toner image corresponding to image information with application of the heat and the pressure in the image forming apparatus such as a photocopier, a printer, and a facsimile employing an image forming process of an electrophotographic method and the like that forms the image on a recording medium by a direct method or an indirect (transfer) method with the toner made of resin having a heat melting property.

The fixing device and the image forming apparatus of the invention has been described above with regard to particular embodiments, but the invention is not limited thereby and it must be understood that the invention encompasses all modifications possible not departing from the scope of the invention.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A fixing device comprising:

a heat member;

a belt member heated by the heat member;

a belt support member operably supporting the belt member;

a first rotation member tightly stretching the belt member with the belt support member;

a second rotation member disposed opposite to the first rotation member through the belt member and pressed against the first rotation member; and a separation contact mechanism making the heat member contact the belt member when the first rotation member rotates and making the heat member separate from the belt member in a state that tension of the belt member is maintained when the first rotation member halts.

2. The fixing device according to claim 1, comprising a connector supplying electric power to the heat member by contacting the heat member, wherein the connector contacts the heat member where the heat member contacts the belt member and is separated from the heat member where the heat member is separated from the belt member.

3. The fixing device according to claim 1, wherein the separation contact mechanism comprises:

a one-way gear, disposed to a heat source support member supporting the heat member, moving in a direction in which the heat member approaches the belt member by rotation of a gear in response to the first rotation member; and a torque limiter, disposed to the gear, idling with respect to the one-way gear by application of a load which is larger than a prescribed amount.

4. The fixing device according to claim 3, wherein the heat source support member includes an urging member urging in a direction in which the heat member is separated from the belt member, and satisfies a relationship Fa>Fb, where Fa is force applied to the heat source support member in a direction in which the heat member approaches the belt member when the first rotation member rotates, and Fb is force applied by the urging member to the heat source support member in a direction in which the heat member is separated from the belt member.

5. An image forming apparatus comprising an image forming unit for forming an image and a fixing device for fixing the image formed at the image forming unit, the fixing device comprising:

a heat member;

a belt member heated by the heat member;

a belt support member operably supporting the belt member;

a first rotation member tightly stretching the belt member with the belt support member;

a second rotation member disposed opposite to the first rotation member through the belt member and pressed against the first rotation member; and a separation contact mechanism making the heat member contact the belt member when the first rotation member rotates and making the heat member separate from the belt member in a state that tension of the belt member is maintained when the first rotation member halts.

6. The image forming apparatus according to claim 5, wherein the fixing device includes a connector supplying electric power to the heat member by contacting the heat member, the connector contacting the heat member where the heat member contacts the belt member and separating from the heat member where the heat member is separated from the belt member.

7. The image forming apparatus according to claim 5, wherein the separation contact mechanism comprises:

a one-way gear, disposed to a heat source support member supporting the heat member, moving in a direction in which the heat member approaches the belt member by rotation of a gear in response to the first rotation member; and a torque limiter, disposed to the gear, idling with respect to the one-way gear by application of a load which is larger than a prescribed amount.

8. The image forming apparatus according to claim 7, wherein the heat source support member includes an urging member urging in a direction in which the heat member is separated from the belt member, and satisfies a relationship Fa>Fb, where Fa is force applied to the heat source support member in a direction in which the heat member approaches the belt member when the first rotation member rotates, and Fb is force applied by the urging member to the heat source support member in a direction in which the heat member is separated from the belt member.

* * * * *